United States Patent [19]

Mullen

[11] 4,018,584

[45] Apr. 19, 1977

[54] AIR CONDITIONING SYSTEM HAVING LATENT AND SENSIBLE COOLING CAPABILITY

[75] Inventor: James Mullen, Marshalltown, Iowa

[73] Assignee: Lennox Industries, Inc., Marshalltown, Iowa

[22] Filed: Aug. 19, 1975

[21] Appl. No.: 605,833

[52] U.S. Cl. ..... 62/175; 62/93; 62/176 B

[51] Int. Cl.[2] ..... F25B 31/00

[58] Field of Search ..... 62/93, 175, 176 E, 209, 62/510, 176 B; 236/44 C

[56] References Cited

UNITED STATES PATENTS

| | | | |
|---|---|---|---|
| 2,461,760 | 2/1949 | Newton | 62/176 |
| 2,665,560 | 1/1954 | Hubbard | 62/176 X |
| 2,691,488 | 10/1954 | Ghai | 62/176 X |
| 3,012,412 | 12/1961 | Muffly | 62/176 |

*Primary Examiner*—William E. Wayner

*Attorney, Agent, or Firm*—Allegretti, Newitt, Witcoff & McAndrews

[57] ABSTRACT

An air conditioning system having latent and sensible cooling capabilities is disclosed herein. The mode of operation is determined by the temperature and humidity conditions of the enclosure.

10 Claims, 3 Drawing Figures

AIR CONDITIONING SYSTEM HAVING LATENT AND SENSIBLE COOLING CAPABILITY

BACKGROUND OF THE INVENTION

The present invention relates generally to an air processing system and more particularly to an air conditioning unit wherein the cooling load and unit capability are substantially matched to increase efficiency and substantially avoid energy waste.

The presently known air processing or conditioning systems inherently produce latent cooling. That is, return air from the conditioned room or enclosure is both sensibly cooled and dehumidified. More particularly, as the return air passes through the evaporator, heat is adsorbed therefrom and moisture therein condenses on the evaporator coils. Both heat and moisture removal result in energy expenditures.

In many instances, the latent capacity of the air conditioning system is excessive in terms of maintaining comfort conditions in the enclosure. If the humidity of the enclosure is acceptable, the dehumidification which normally occurs in the presently known systems is unnecessary and wasteful of energy.

SUMMARY OF THE INVENTION

In a principal aspect, the present invention is an air processing or conditioning system including multiple compressor means, evaporator means, condenser means, and control means. The controls means, which discriminately selects and controls the mode of operation of the system, is responsive to temperature and humidity sensing means within the enclosure to be conditioned.

Under acceptable humidity conditions, the multiple compressor means is operated at a predetermined low flow rate to provide substantially sensible cooling of the return air. The multiple compressor means is operated at a predetermined high flow rate, whenever the humidity in the enclosure exceeds a predetermined humidity threshold, to provide both latent and sensible cooling.

It is thus an object of the present invention to provide an air processing system wherein the unit capabilty or capacity is substantially matched to the cooling load to substantially avoid energy waste.

It is another object of the present invention to provide an improved air conditioning system with latent and sensible cooling capacities.

It is also an object of the present invention to provide an air conditioning unit having latent and sensible cooling capacities wherein the mode of operation is automatically controlled with respect to conditions within the enclosure.

It is yet another object of the present invention to provide an air conditioning system wherein substantially sensible cooling alone is produced under predetermined enclosure humidity conditions.

It is a further object of the present invention to provide an improved air conditioning system which is readily and inexpensively manufactured.

These and other objects, features and advantages of the present invention will become apparent in the following detailed description.

BRIEF DESCRIPTION OF THE DRAWINGS

A preferred embodiment of the present invention will be described, in detail, with reference to the drawing wherein.

DESCRIPTION OF THE PREFERRED EMBODIMENT

Figure 1:
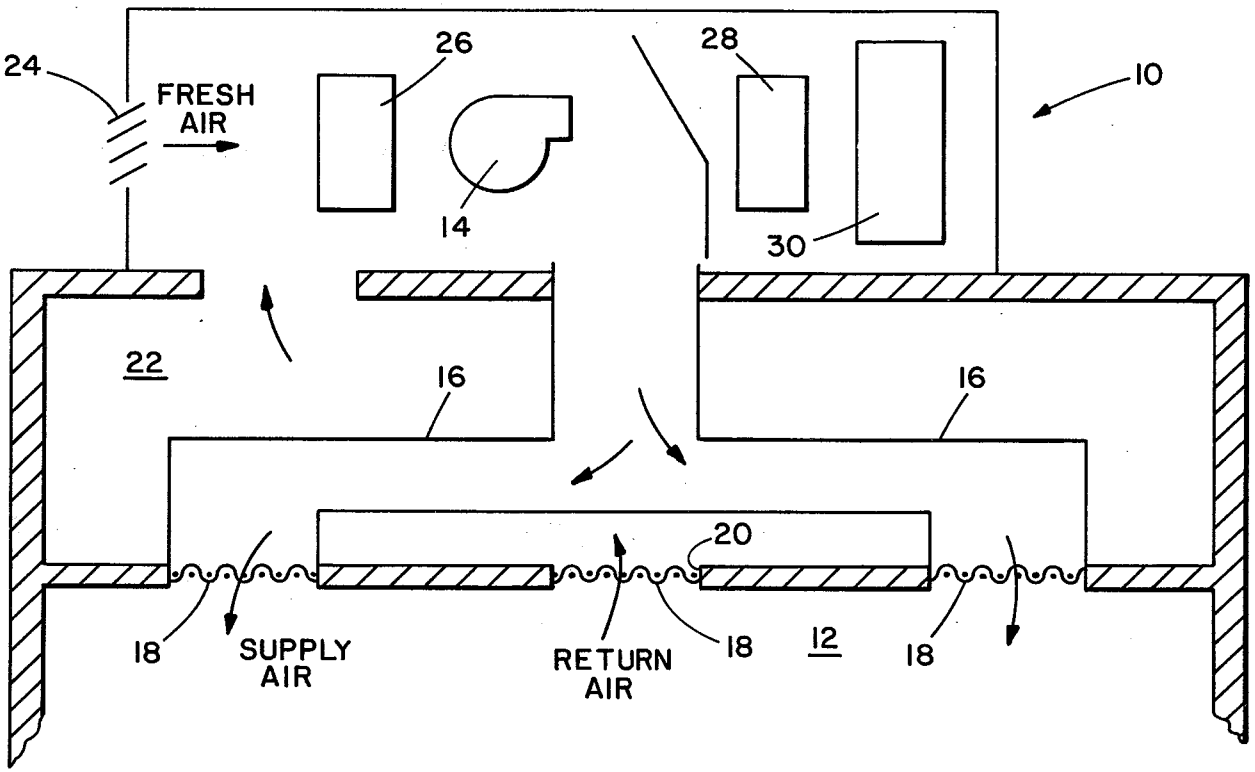
FIG. 1 is a schematic diagram of an air conditioning system incorporating a preferred embodiment of the present invention.
Figure 2:
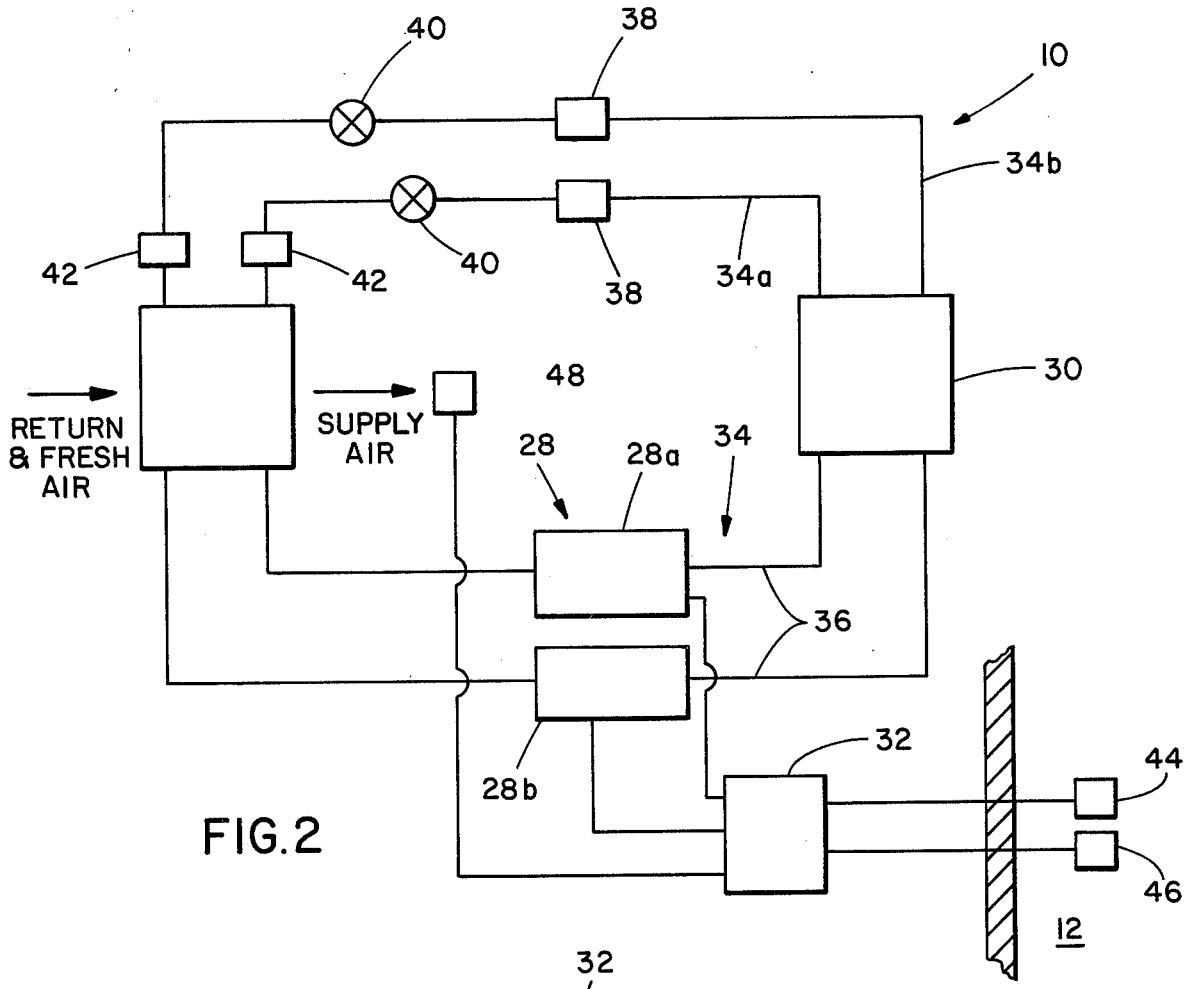
FIG. 2 is a schematic diagram of the refrigeration circuit and preferred embodiment shown in FIG. 1.

Referring to FIGS. 1 and 2, a preferred embodiment of the present invention is shown schematically as an improved air processing system, generally designated 10. The system 10 conditions the air in an enclosure or room 12. As shown, and for purposes of illustration alone, the system 10 is a single zone, roof-top unit which forces processed supply air into the enclosure 12 by a blower 14 through a series of supply air ducts 16. The supply air ducts 16 are covered by grills 18.

Return air circulates through a return air vent 20, also covered by a grill 18, and a plenum 22 to the system 10. The return air is combined and mixed with fresh outdoor air, prior to processing, for ventilation purposes. The amount of the fresh outdoor air is controlled by dampers, generally designated 24.

The system 10 includes evaporator means 26, multiple compressor means, generally designated 28, condenser means 30 and control means 32. The evaporator means 26, multiple compressor means 28 and condenser means 30 are connected in a refrigeration circuit, generally designated 34.

As used herein, the term "multiple compressor means" defines a compressor means having a predetermined low flow rate and at least one higher flow rate, or an equivalent thereto. Thus, "multiple compressor means" includes a multiple-speed compressor, cylinder unloading compressor, screw compressor with unloading capability, multiple single-speed, fixed capacity compressors, or combinations thereof. With referenceto FIGS. 2 and 3, in this preferred embodiment of the present invention, the multiple compressor means 28 includes a two-speed capacity control compressor **28*a* and a secondary fixed-capacity compressor 28*b*.**

As shown, the compressors **28*a*, 28*b* are incorporated in separate refrigeration circuits 34*a*, 34*b*, respectively. In this preferred embodiment, the evaporator means 26 is "face-split" between the circuits 34*a*, 34*b*. More particularly, the coils in the lower half of the evaporator means 26, with reference to the air flow, are connected in circuit 34*a*.** The "face splitting" of the evaporator coils, in contrast with "row splitting", substantially facilitates latent cooling of the return air.

Similarly, the condenser means 30 is split between the refrigeration circuit **34*a*, 34*b*. Each refrigeration circuit 34*a*, 34*b* includes an interconnection conduit 36 carrying a refrigerant, liquid line filter dryer 38, expansion valve 40 and refrigerant distributor 42,** interconnected as shown.

Referring again to FIGS. 2 and 3, the control means 32 is responsively connected to temperature means 44 for sensing the air temperature in the enclosure 12, humidity means 46 for sensing the humidity therein and supply means 48 for sensing the temperature of the supply air delivered to the enclosure 12. The temperature and humidity means 44, 46 are disposed in the enclosure 12. The supply means 48 is in direct communication with the supply air stream. Alternatively, the humidity means 46 is disposed in the return air stream.

The temperature means 44 is similar in function to a conventional room thermostat. The temperature means 44 has an adjustable set point or cooling threshold and produces a DC voltage proportional to the temperature differential between the dry bulb enclosure air temperature and the cooling threshold.

The supply means 48 produces a voltage proportional to the supply air temperature. The signal from the temperature means 44 and supply means 48 are combined in the control means 32 to dampen the response of the system 10 to cooling demands.

The humidity means 46, which includes a dehumidistat switch 50, has an adjustable humidity set point or threshold. When the relative humidity of the enclosure air rises above the humidity threshold, the dehumidistat switch 50 closes.

The control means 32 is a logic control panel, such as presently manufactured and sold by Ranco Controls of Columbus, Ohio, under the name EA4 Load Analyzer Control Module. The Ranco control module is described, in detail, in U.S. Pat. No. 3,820,713, incorporated herein by reference.

Figure 3:
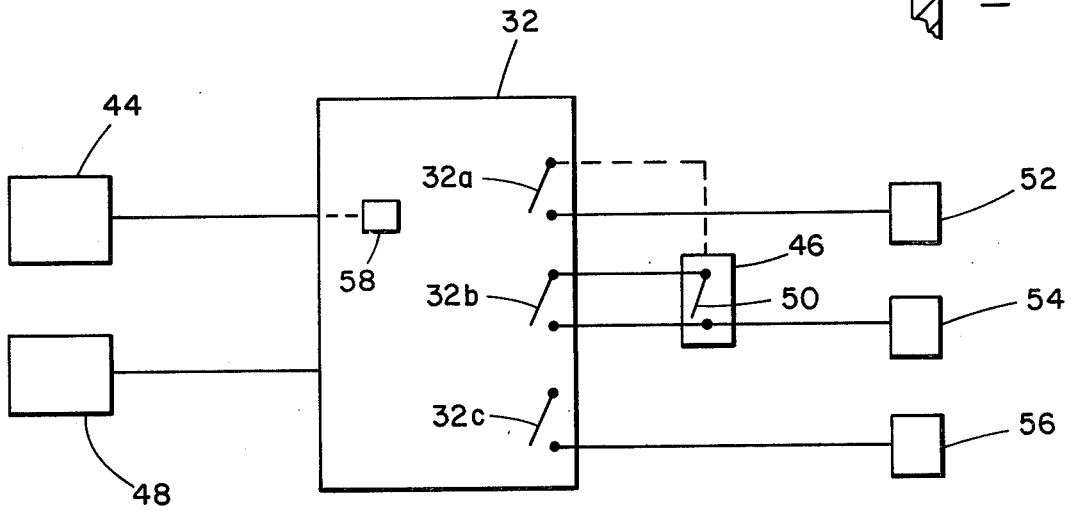
FIG. 3 is a schematic diagram of the control circuit for use in the preferred embodiment shown in FIG. 2.

As shown in FIG. 3, the control means 32 includes a series of logic relays **32*a*, 32*b*, 32*c* interconnected with compressor controls 52, 54, 56, respectively. The controls 52, 54 operate the compressor 28*a* at the low and high speeds or flow rates, respectively. The compressors 28*a*, 28*b* are cycled "on" and "off", "high" and "low" by the control means 32 through the controls 52, 54, 56 to provide the necessary cooling capacity for the enclosure 12.**

The dehumidistat switch 50 of the humidity means 46 is connected in parallel with the logic relay **32*b*. The switch 50 is mechanically and electrically interconnected with the logic relay 32*a*, such that the relay 32*a* remains open whenever the switch 50** is closed, as discussed in detail below.

In this preferred embodiment of the present invention, the control means 32 also includes load means for sensing the cooling load in the enclosure 12. The load means 58 is responsive to the temperature means 44 and defines a predetermined load threshold representing a percentage of the load design of the system 10. The magnitude of the voltage produced by the temperature means 44 is proportional to the cooling load in the enclosure 12. Preferably, the load threshold is in the range of 30 to 50 percent of load design.

The control means 32 selects and effects the mode of operation of the system 10 or, more particularly, the necessary flow rate of the multiple compressor means 28. Selection is made by operation of logic relays **32*a*, 32*b*, 32*c* in response to the temperature means 44, humidity means 46, and supply means 48.** Generally, the required flow rate increases with cooling load.

The control means 32 has four states. Whenever the temperature threshold of the temperature means 44 exceeds the enclosure air temperature, the control means 32 is in a first state and deactivates the multiple compressor means 28. That is, the system 10 is inoperative whenever the enclosure temperature is acceptable.

When the enclosure air temperature exceeds the cooling threshold and acceptable humidity and load conditions exist in the enclosure 12, the control means 32 is in a second state and operates the multiple compressor means 28 at the low flow rate. More particularly, the two-speed compressor 28 is cycled on" and "off", as necessary, at the low speed.

If both temperature and humidity conditions in the enclosure 12 are unacceptable, the control means 32 is in a third state to cooperatively operate the compressors **28*a*, 28*b*. In this state, the compressor 28*a* is maintained in the high speed mode, such that low flow rate operation of the multiple compressor means 28** is substantially avoided.

When the cooling demand becomes excessive, i.e., the cooling load in the enclosure 12 exceeds the predetermined load threshold of the load means 58, the control means 32 is in a fourth state and operates the compressors **28*a*, 28*b* in combination to provide high flow rate operation of the multiple compressor means 28.**

Operation of the multiple compressor means 28 at the low flow rate, i.e., operation of compressor **28*a* alone at the low speed, provides substantially sensible cooling. That is, the evaporator means 26, under most operating conditions, has a temperature above the dew point of the return air from the enclosure 12, and water vapor therein does not condense on the coils of the evaporator means 26.** Thus, substantially only sensible heat is removed from the return air stream.

In this preferred embodiment, substantially sensible cooling is produced only when the humidity and load thresholds of the humidity means 46 and load means 58, respectively, exceed the humidity and cooling load in the enclosure 12. When the relative humidity in the enclosure 12 becomes unacceptable, the dehumidistat switch 50 closes to provide latent and sensible cooling. As previously discussed, the switch 50 and logic relay **32*a* are interconnected, thereby preventing low flow rate operation of the multiple compressor means 28** whenever the enclosure air humidity exceeds the humidity threshold.

Whenever the cooling load in the enclosure 12 exceeds the predetermined load threshold, the control means 32 causes high flow rate operation of the multiple compressor means 28 to substantially match cooling load and system capability. That is, the control means 32 effects both latent and sensible cooling, regardless of humidity conditions in the enclosure 12, by activation of the compressors **28*a*, 28*b*.**

More particularly, as sensible load in the enclosure 12 increases, the multiple compressor means 28 is operated in accordance with the following tables. Table I represents operation without a demand for dehumidification; Table II sets forth operation under a dehumidification demand. Higher "Demand State" numbers indicate greater sensible loads.

TABLE I

| Demand State | Compressor | Mode |
|---|---|---|
| 1 | 28a | Cycling - low speed |
| | | Off |
| 2 | 28a | Low speed |
| | 28b | Cycling |
| 3 | 28a | Cycling between high and low speeds |
| | 28b | On |
| 4 | 28a | High speed |
| | 28b | On |

TABLE II

| Demand State | Compressor | Mode |
|---|---|---|
| 1 | 28a | Cycling - high speed |

TABLE II-continued

| Demand State | Compressor | Mode |
|---|---|---|
| | 28b | Off |
| 2 | 28a | High speed |
| | 28b | Cycling |
| 3 | 28a | High speed |
| | 28b | On |

Theoretical studies of the preferred embodiment disclosed herein indicate substantial savings in cooling energy consumption. Although dependent upon several variables, e.g., climate, building design and occupancy, estimates of savings are five percent (5%) in very humid climates and approximately twenty percent (20%) in very dry climates.

An alternative and simplified embodiment of the present invention includes a conventional thermostat, humidity sensing device and two-speed compressor. In each mode of operation, i.e., high and low flow rate, the entire evaporator coil system is utilized. At the low flow rate, substantially sensible cooling alone is achieved. The humidity sensing device cancels low flow rate operation whenever the enclosure humidity becomes unacceptable, thereby providing the sensible and latent cooling. In this embodiment, the control means 32 is only operable in the first, second and third states, as previously defined.

In another embodiment, the compressor means is a fixed capacity compressor and the evaporator means is appropriately valved. To provide sensible cooling, the entire coil system is utilized; in the total cooling mode, only a portion of the coil system is used, thereby decreasing the coil surface temperature.

Various embodiments of the present invention have been described herein. It is to be understood, however, that various changes and modifications can be made without departing from the true scope and spirit of the present invention, as set forth and defined by the following claims.

What is claimed is:

1. In an air conditioning system for an enclosure of the type having evaporator means, condenser means and multiple compressor means, said enclosure defining an enclosure air temperature, an enclosure air humidity and a cooling load, said multiple compressor means having a low flow rate and at least one high flow rate, the improvement comprising, in combination:

temperature means for sensing said enclosure air temperature, said temperature means defining at least one temperature threshold;

humidity means for sensing said enclosure air humidity, said humidity means defining a humidity threshold; and control means for operatively controlling said multiple compressor means in response to said temperature means and said humidity means, said control means being operable in a first state whenever said temperature threshold exceeds said enclosure air temperature to deactivate said multiple compressor means, said control means being operable in a second state whenever said enclosure air temperature exceeds said temperature threshold and said humidity threshold exceeds said enclosure air humidity to operate said multiple compressor means at said low flow rate, whereby said evaporator means operates at a predetermined high temperature to substantially sensibly cool said enclosure, said control means being operable in at least a third state whenever said enclosure air temperature exceeds said threshold temperature and said enclosure air humidity exceeds said humidity threshold to operate said multiple compressor means at said high flow rate, whereby said evaporator means operates at a predetermined low temperature to latently cool said enclosure.

2. An improvement as claimed in claim 1 wherein said control means includes load means for sensing said cooling load, said load means defining a predetermined load threshold.

3. An improvement as claimed in claim 2 wherein said control means is operable in a fourth state whenever said enclosure air temperature exceeds said temperature threshold and said cooling load exceeds said predetermined load threshold to operate said multiple compressor means at said high flow rate and provide latent cooling in said fourth state.

4. An improvement as claimed in claim 3 wherein said multiple compressor means is a two-speed compressor.

5. An improvement as claimed in claim 3 wherein said multiple compressor means is a cylinder unloading compressor.

6. An improvement as claimed in claim 3 wherein said humidity means includes a dehumidistat switch.

7. An improvement as claimed in claim 1 wherein said air conditioning system includes a first and second refrigeration circuit, said evaporator means and said multiple compressor means being incorporated into said first and second refrigeration circuits.

8. An improvement as claimed in claim 7 where said evaporator means is face-split between said first and second refrigeration circuits to facilitate latent cooling of said enclosure.

9. An improvement as claimed in claim 7 wherein said multiple compressor means includes a first and second compressor incorporated into said first and second refrigeration circuits, respectively.

10. An improvement as claimed in claim 9 wherein said first compressor is a multiple-speed compressor.

* * * * *